United States Patent [19]

Parr

[11] 4,244,064

[45] Jan. 13, 1981

[54] STEP STOOL CONSTRUCTION

[76] Inventor: Linda C. Parr, Rte. 1, Box 562, Spartanburg, S.C. 29302

[21] Appl. No.: 89,607

[22] Filed: Oct. 29, 1979

[51] Int. Cl.[3] ..... E03D 11/00

[52] U.S. Cl. ..... 4/254; 4/574

[58] Field of Search ..... 4/254, 185 R, 185 S, 4/185 L, 186

[56] References Cited

U.S. PATENT DOCUMENTS

| | | | |
|---|---|---|---|
| 933,148 | 9/1909 | Wilson | 4/254 |
| 1,674,116 | 6/1928 | Lord | 4/254 |
| 1,798,632 | 3/1931 | Romer | 4/254 |
| 2,120,481 | 6/1938 | Bentz | 4/254 |
| 2,122,832 | 7/1938 | Bentz | 4/254 |
| 2,243,264 | 5/1941 | Stromblad | 4/254 |
| 2,250,060 | 7/1941 | Finlay | 4/254 |
| 2,607,926 | 8/1952 | De Puy | 4/254 |
| 2,629,882 | 3/1953 | Blumenshine | 4/254 |
| 2,834,028 | 5/1958 | Stanley | 4/254 |
| 2,851,697 | 9/1958 | Dubay et al. | 4/254 |
| 3,383,714 | 5/1968 | Minasian et al. | 4/254 |

*Primary Examiner*—Henry K. Artis

*Attorney, Agent, or Firm*—Wellington M. Manning, Jr.; Luke J. Wilburn, Jr.

[57] ABSTRACT

A step stool defining a U-shaped opening in a rear portion of same with at least one elevated step in front of the U-shaped opening, whereby the stool may be received about a portion of the base of a toilet bowl. Threaded bolts are received in threaded openings through side walls of the stool to be tightened against the sides of the toilet bowl to stabilize the stool thereat. A generally U-shaped insert is also provided which may be received and held within the U-shaped openings of the stool to convert the stool to a conventional step stool.

11 Claims, 4 Drawing Figures

STEP STOOL CONSTRUCTION

This invention relates to an improved step stool construction particularly designed to assist and facilitate toilet training of small children and, more particularly, to a lightweight, economically constructed step stool which may be secured in place about the front portion of a toilet bowl to assist small children in performing body elimination functions, and which stool is further provided with a removable wall insert attachable thereto whereby the stool may be employed as a conventional step stool for other uses.

BACKGROUND OF THE INVENTION

It is known to provide step devices adjacent a toilet bowl to enable small children to more easily postion themselves for performance of normal body functions, i.e., urination and defecation. Certain of such step constructions are exemplified in the following prior U.S. Pat. Nos. 2,120,481, 2,250,060, 2,607,926, 2,629,882, 2,834,028, 2,851,697 and 3,383,714, and generally include a raised step surface located adjacent the front portion of the toilet bowl. Certain of the devices described in the aforementioned patents are of relatively heavy and complicated construction, relatively expensive to manufacture, and require manipulation or adjustment by the child or parent before they can be placed for use. Certain of the constructions must be permanently affixed to the floor or to the toilet seat, as illustrated by U.S. Pat. Nos. 2,250,060; 2,629,882; and 3,383,714.

OBJECTS OF THE INVENTION

It is therefore an object of the present invention to provide an improved; inexpensive, lightweight toilet bowl step stool of generally unitary construction which may be easily used by a young child without parental assistance, and which may be temporarily and easily affixed to the base of the toilet bowl to facilitate stability of the stool when in use.

It is a further object to provide a lightweight step stool of relatively inexpensife construction which may be produced of molded plastic in a conventional molding operation.

It is another object to provide an improved step stool of generally unitary, lightweight construction adapted to facilitate the toilet training of small children, which stool is provided with removable insert to enable use of the stool as a conventional step stool for other purposes.

BRIEF DESCRIPTION OF THE DRAWINGS

The above as well as other objects of the invention will become more apparent from the following detailed description of a preferred embodiment thereof, when taken together with the accompanying drawings, in which.

BRIEF DESCRIPTION OF THE INVENTION

Briefly, the present invention comprises a lightweight step stool of generally unitary construction designed to facilitate and assist in toilet training of young children. The stool has a generally horizontal step surface with rearwardly extending elevated horizontal wall positions forming a generally U-shaped opening in the rear of same such that the stool may be located in closely surrounding relation to front and side portions of a toilet bowl. Adjustable fastening means are provided in opposed side walls of the stool to engage side walls of the toilet bowl base to facilitate stability of the stool in use.

In a preferred embodiment, the stool is provided with a second elevated step further located immediately adjacent the toilet bowl, and a removable wall insert for closing the U-shaped opening to convert the stool for more conventional uses.

The construction of the stool permits its ready manufacture from plastic materials in a conventional molding operation.

DETAILED DESCRIPTION OF PREFERRED EMBODIMENT

Figure 1:
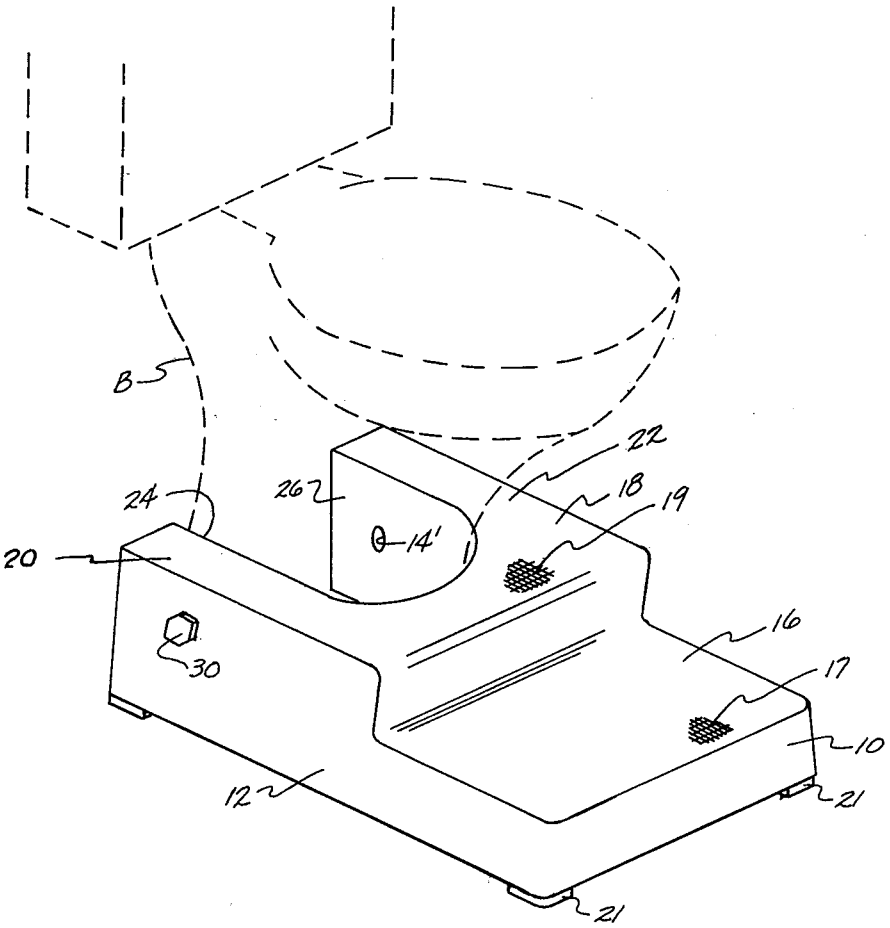
FIG. 1 is a schematic perspective view of a step stool construction of the present invention, illustrating the position of the stool adjacent the base of a toilet bowl for use by small children in performing their body functions.
Figure 2:
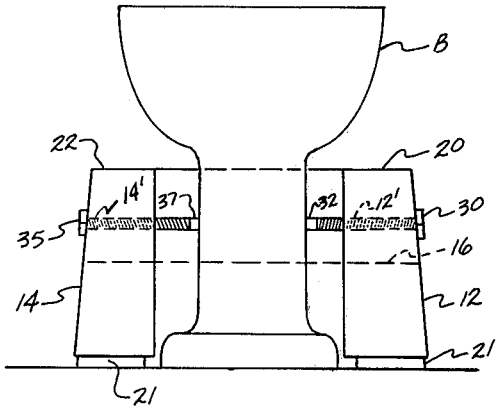
FIG. 2 is a rear elevational view of the stool, more clearly illustrating the manner in which the stool is readily temporarily secured to the base of a toilet bowl when in use to facilitate toilet training of small children.
Figure 3:
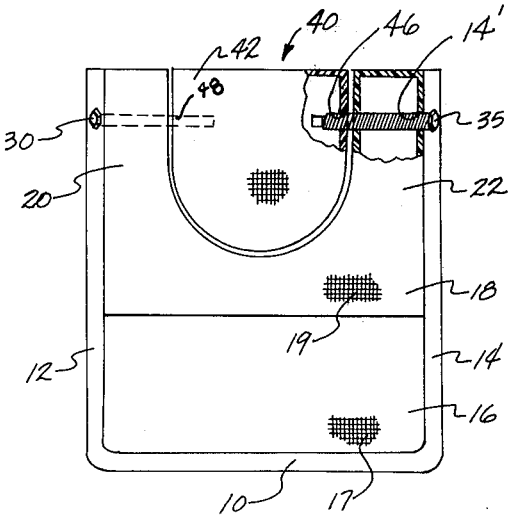
FIG. 3 is a plan view of the step stool construction of FIG. 1, with removable step surface insert secured therein to adapt the stool for conventional uses.

Referring more particularly to the drawings, a preferred embodiment of the step stool is shown in FIGS. 1–3 to be of molded, generally unitary construction. The general perimeter base of the step stool includes a front vertical wall 10 and side walls 12 and 14, all of which are connected along the upper surfaces of same with horizontal top walls 16 and 18. Top walls 16 and 18 are located at two elevations from a surface on which the stool may rest, and as such, form two horizontal step surfaces.

Extending rearwardly from top horizontal step surface 18 are two thin, elongate, horizontal wall strips 20 and 22 which likewise are secured to an upper surface of side walls 12 and 14 respectively. Top wall sections 18, 20 and 12 define a generally U-shaped opening 24 in the upper surface of the stool, which opening extends downwardly through the stool, being further so defined by an internal U-shaped horizontal wall section 26.

As seen in FIG. 1, the base of the toilet bowl B is received within U-shaped opening 24 with step surfaces 16 and 18 located in front of same, and elongate wall strips 20 and 22 extending rearwardly in coplaner relation with step 18, partially about the sides of bowl B.

As best seen in FIGS. 1 and 2, the step stool of the present invention is preferably provided with adjustable fastening means for securement to opposite sides of bowl 26. A pair of threaded bolts 30 and 35 are illustrated being received through threaded openings 12' and 14' in defined vertical support walls, 12, 14 and 26 below the elongate horizontal wall portions 20 and 22. Bolts 30 and 35 extend into the generally U-shaped opening 24 of the step stool and may be rotated by hand through the wall openings 12' and 14' to firmly engage the sides of the base of toilet bowl B to temporarily secure the step stool thereto and provide more positional stability for the stool when in use. The ends of threaded bolts 30, 35 which contact the sides of bowl B may be provided with suitable deformable friction means, such as rubber tips 32, 37, respectively, to facilitate non-movable engagement of the bolts with the smooth sides of bowl B.

As further illustrated in FIGS. 1 and 2, step surfaces 16 and 18 may be provided with a non-skid surface, as exemplified by knurled areas 17 and 19. While only a portion of steps 16 and 18 are illustrated with a knurled surface, obviously the entire step surface, or any particular portion of same could be so provided. Further, instead of the molded in knurled surfaces 17 and 19, a separate element having non skid characteristics (not shown) could be secured to steps 16 and 18. In like fashion, the bottom surfaces of the stool may be provided with friction surfaces, exemplified by pads 21 secured to the underside of walls defining the stool.

The stool construction of the present invention is preferably constructed of a lightweight, strong, synthetic polymeric material, with same being manufactured by a conventional molding operation. As seen in FIGS. 2 and 3, the side walls of the stool may flare downwardly at a slight angle, e.g., about 5 degrees to facilitate removal of the stool from a forming mold and provide further stability of the stool in use.

As can be seen from the foregoing description and illustrative drawings, the step stool construction of the present invention provides a two-step arrangement whereby both male and female children of various heights may gain ready access to the toilet bowl for use, with the feet thereof firmly supported on one or the other of the step surfaces of the stool when a child is either in a standing postion in front of the toilet bowl, or in a seated position on the toilet. Because of the securement of the step stool to the base of the toilet bowl, the stool is not susceptible to ready displacement or removal during use, thereby providing additional stabilty to the same.

Figure 4:
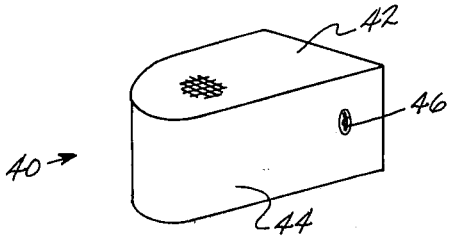
FIG. 4 is a perspective view of the removable step surface insert as shown in FIG. 3.

As best seen in FIGS. 3 and 4, the stool construction of the present invention is readily convertible for use as a conventional step stool for gaining access to areas above the reach of the user, such as reaching articles on high shelves, cleaning, painting walls, and the like. In this respect, the stool may be provided with a generally U-shaped, removable insert generally indicated as 40 and having a flat step surface 42 supported by vertical side wall portions 44 of unitary construction therewith. Side wall portions 44 define openings 46 and 48 therein which align with the openings 12' and 14' in walls 12, 24, 26, whereby adjustable fastening means 30 and 35 may rigidly secure insert 40 within U-shaped opening 24 of the step stool. Likewise further fastening means may be utilized if desired. Insert 40 is preferably manufactured for a tight fitting relationship with U-shaped opening 24, and may if desired have portions thereof that mate with complementary portions of the step stool to further rigidify the connection therebetween. With insert 40 in place, step surface 42 is coplanar to surfaces 18, 20 and 22 of the step stool to define a large second step surface. The removable insert 40 also may be suitably formed of molded plastic, as the main body of the stool construction.

Bolts 30 and 35 for securing the stool to the sides of the toilet bowl B, as well as securing removable insert 40 within U-shaped opening 26 thereof, may also be formed of molded plastic, or any other material suitable for threaded engagement with openings in the side walls of the stool. The heads of the bolts may be of relatively large size so as to be easily engaged and rotated by the hand, without necessity of tools to secure the stool to the toilet or modify the same to conventional use by insertion of the removable insert 40.

Although the preferred embodiment of the stool shown in FIGS. 1–3 has two step levels 16, 18, the stool could be provided with only a single step level, if desired, with the elongate horizontal spaced wall portions which extend along sides of the toilet bowl being coplaner and formed integral therewith.

From the foregoing description, it can be seen that the improved step stool construction of the present invention provides lightweight, economical device for use in toilet training of small children, while providing conventional use of the stool when desired.

That which is claimed is:

1. A step stool adapted to be removably receivable about the base of the toilet bowl to facilitate toilet training of small children comprising:

(a) a horizontal wall means defining at least one step surface, said wall means including a pair of relatively narrow, elongate horizontal wall portions secured thereto and extending rearwardly therefrom whereby said horizontal wall means defines a generally U-shaped opening thereat for receiving the base of a toilet bowl therein;

(b) generally vertical wall portions secured to said horizontal wall means and extending downwardly therefrom to space and support said horizontal wall means above a stool support surface; and (c) adjustable holding means associated with legs of said U-shaped opening to engage the base of said toilet bowl on opposite sides of same for removably securing said stool thereto.

2. The stool as defined in claim 1 wherein the holding means comprises threaded rods that are threadably received through opposite generally vertical wall portions that are secured to said narrow elongate horizontal wall portions, said threaded rods being contactable with the base of said toilet bowl to hold said stool thereat.

3. The stool as defined in claim 2 wherein said walls are of unitary construction.

4. The stool as defined in claim 3 wherein said horizontal wall means defines a plurality of steps forward of said U-shaped opening.

5. The stool as defined in claim 4 wherein said steps have non-skid surfaces thereon.

6. The stool as defined in claim 5 wherein the generally vertical wall portions have a slight outward taper from top to bottom.

7. The stool as defined in claim 2 wherein said threaded rods have deformable means at an end thereof for insuring good contact with said bowl.

8. The stool as defined in claim 1 comprising further a generally U-shaped insert receivable in said U-shaped opening, said insert having a horizontal top wall that is generally coplanar with said horizontal wall means adjacent said U-shaped opening, said insert further having means thereon for receiving said holding means whereby said insert can be securely held in said U-shaped opening.

9. The stool as defined in claim 8 wherein said means for receiving said holding means are openings defined in walls of said insert in alignment with said holding means.

10. A convertible stool comprising:

(a) a horizontal wall means defining at least one step surface, said wall means including a pair of relatively narrow, elongated horizontal wall portions extending rearwardly thereof whereby said horizontal wall means defines a generally U-shaped opening thereat;

(b) generally vertical wall portions secured to said horizontal wall means and extending downwardly therefrom to space and support said horizontal wall means above a stool support surface;

(c) an insert shaped to be received in said generally U-shaped opening, said insert including side walls and a horizontal top wall, said top wall being coplanar with said horizontal wall means adjacent said U-shaped opening; and (d) insert securement means for securing said insert within said U-shaped opening, whereby when said insert is secured within said U-shaped opening, a conventional step-stool is provided, and when said insert is removed from said U-shaped opening, said stool may be placed about the base of a a toilet bowl to facilitate toilet training of small children.

11. The stool as defined in claim 10 wherein said horizontal wall means defines a plurality of steps, each of said steps having a non-skid surface thereon, said and wherein said insert securement means include at least one threaded rod threadably received by certain of said generally vertical wall portions secured to said horizontal wall means and side walls of said insert.

* * * * *

UNITED STATES PATENT AND TRADEMARK OFFICE

CERTIFICATE OF CORRECTION

PATENT NO. : 4,244,064

DATED : January 13, 1981

INVENTOR(S) : Linda C. Parr

It is certified that error appears in the above-identified patent and that said Letters Patent are hereby corrected as shown below:

Column 1, line 44, "inexpensife" should read--inexpensive--.

Column 4, claim 1, line 16, "the", second occurrence, should read--a--.

Column 6, claim 11, line 8, delete "said", second occurrence.

Signed and Sealed this

*Seventeenth* Day of *March 1981*

[SEAL]

*Attest:*

RENE D. TEGTMEYER

*Attesting Officer*

*Acting Commissioner of Patents and Trademarks*